US010324395B2

(12) United States Patent
Josiah et al.

(10) Patent No.: US 10,324,395 B2
(45) **Date of Patent: *Jun. 18, 2019**

(54) TONER CARTRIDGE PRINTER DEVICES, SYSTEMS, AND METHODS FOR UNDER PRINTING

(71) Applicant: UI Technologies, Inc., Las Vegas, NV (US)

(72) Inventors: Michael Raymond Josiah, North Patchogue, NY (US); Joseph Dovi, Lake Grove, NY (US)

(73) Assignee: UI Technologies, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/722,562

(22) Filed: Oct. 2, 2017

(65) Prior Publication Data

US 2018/0046108 A1 Feb. 15, 2018

Related U.S. Application Data

(63) Continuation of application No. 15/408,186, filed on Jan. 17, 2017, now Pat. No. 9,835,968, which is a (Continued)

(51) Int. Cl.

| | |
|---|---|
| ***G03G 15/01*** | (2006.01) |
| ***G03G 15/08*** | (2006.01) |
| ***G03G 15/00*** | (2006.01) |

(52) U.S. Cl.

CPC ..... *G03G 15/0121* (2013.01); *G03G 15/0178* (2013.01); *G03G 15/0863* (2013.01);

(Continued)

(58) Field of Classification Search

CPC ..... G03G 15/0121; G03G 15/0178; G03G 15/6585

See application file for complete search history.

(56) References Cited

U.S. PATENT DOCUMENTS

| | | | |
|---|---|---|---|
| 4,630,076 | A | 12/1986 | Yoshimura |
| 4,943,506 | A | 7/1990 | Demizu et al. |

(Continued)

FOREIGN PATENT DOCUMENTS

| | | |
|---|---|---|
| EP | 0280378 | 3/1995 |
| WO | 2014206673 | 12/2014 |

OTHER PUBLICATIONS

Robert-Bosch; Digital Transfer Media for Printers with White Toner; website; Oct. 29, 2014; 8 pages; Forever GmbH Digital Transfer Applications Technology; Heddesheim, Germany; http://www.seri-deco.fi/files/Forever%20No-Cut_white%20toner%20flyer.pdf.

(Continued)

*Primary Examiner* — Walter L Lindsay, Jr.
*Assistant Examiner* — Jessica L Eley
(74) *Attorney, Agent, or Firm* — Kevin Schraven; Anooj Patel; Hankin Patent Law, APC

(57) ABSTRACT

A method of converting a CMYK color toner printer to a CMYX color toner printer for under print printing in a single pass, comprising the steps: providing a color toner printer with four toner printing cartridges: a cyan toner printing cartridge, a magenta toner printing cartridge, a yellow toner printing cartridge, and a black toner printing cartridge; wherein the black toner printing cartridge is in a first toner cartridge position; removing the back toner printing cartridge from the first toner cartridge position; providing a non-standard toner printing cartridge; installing the non-standard toner printing cartridge into the first toner cartridge position; providing a raster image processor software; wherein the raster image processor software is configured to remap the four toner printing cartridges of the color toner printer and allows the color toner printer to print a layer of non-standard toner under an image in a single pass; and (Continued)

wherein the image is printed from at least one of a cyan toner, a yellow toner, and a magenta toner.

11 Claims, 15 Drawing Sheets

Related U.S. Application Data continuation-in-part of application No. 15/286,875, filed on Oct. 6, 2016, now Pat. No. 9,835,981, which is a continuation-in-part of application No. 14/879,548, filed on Oct. 9, 2015, now Pat. No. 9,488,932, which is a continuation-in-part of application No. 14/731,785, filed on Jun. 5, 2015, now Pat. No. 9,383,684.

(52) U.S. Cl.
CPC ..... *G03G 15/0894* (2013.01); *G03G 15/6585* (2013.01); *G03G 15/0867* (2013.01); *G03G 2215/00987* (2013.01)

(56) References Cited

U.S. PATENT DOCUMENTS

| | | | | |
|---|---|---|---|---|
| 5,223,906 | A | 6/1993 | Harris | |
| 5,367,327 | A | 11/1994 | Harris | |
| 6,114,077 | A | 9/2000 | Voets et al. | |
| 6,203,953 | B1 | 3/2001 | Dalal | |
| 6,249,655 | B1 | 6/2001 | Baek et al. | |
| 6,535,712 | B2 | 3/2003 | Richards | |
| 6,633,396 | B1 * | 10/2003 | Barry | B41J 29/393 358/1.14 |
| 6,640,843 | B2 | 11/2003 | Lee | |
| 6,769,766 | B2 | 8/2004 | Suzuki et al. | |
| 6,975,428 | B1 | 12/2005 | Ernst | |
| 7,061,503 | B2 | 6/2006 | Newman | |
| 7,134,749 | B2 | 11/2006 | Ben-Zer et al. | |
| 7,261,390 | B2 | 8/2007 | Nishino | |
| 7,717,532 | B2 | 5/2010 | Kroon et al. | |
| 8,205,981 | B1 | 6/2012 | Marino et al. | |
| 8,298,737 | B2 | 10/2012 | Kadokura | |
| 8,348,399 | B2 | 1/2013 | Gengrinovich | |
| 8,351,100 | B2 | 1/2013 | Mestha et al. | |
| 8,599,436 | B2 | 12/2013 | Sano et al. | |
| 8,728,696 | B2 | 5/2014 | Yamada | |
| 8,735,320 | B2 | 5/2014 | La Costa | |
| 8,784,508 | B2 | 7/2014 | Ellis | |
| 8,851,641 | B2 | 10/2014 | Kamiyama | |
| 2004/0037573 | A1 | 2/2004 | Hirota | |
| 2004/0252173 | A1 | 12/2004 | Ben-Zur et al. | |
| 2005/0264632 | A1 | 12/2005 | Glass et al. | |
| 2005/0271401 | A1 * | 12/2005 | Burchette | G03G 15/553 399/24 |
| 2006/0034509 | A1 | 2/2006 | Lu et al. | |
| 2006/0162586 | A1 | 7/2006 | Fresener et al. | |
| 2008/0218539 | A1 | 9/2008 | Hill et al. | |
| 2008/0292332 | A1 | 11/2008 | Okano | |
| 2009/0040249 | A1 | 2/2009 | Wouters | |
| 2010/0177366 | A1 | 7/2010 | Mestha | |
| 2012/0051816 | A1 | 3/2012 | Chiyoda | |
| 2012/0189337 | A1 | 7/2012 | Takemura | |
| 2013/0078001 | A1 | 3/2013 | Koido | |
| 2013/0108345 | A1 * | 5/2013 | Yamamoto | G03G 15/5087 400/76 |
| 2013/0113854 | A1 | 5/2013 | Iwata | |
| 2013/0235398 | A1 | 9/2013 | Bhatti et al. | |
| 2013/0251411 | A1 | 9/2013 | Miura | |
| 2013/0308985 | A1 | 11/2013 | Kim | |
| 2013/0330522 | A1 | 12/2013 | Suzuki et al. | |
| 2014/0056617 | A1 * | 2/2014 | Rimai | G03G 15/224 399/130 |
| 2014/0292855 | A1 | 8/2014 | Chang | |

OTHER PUBLICATIONS

Anthony Dinezza; Can a Printer Print White Color; website forum; Apr. 15, 2014; 3 pages; http://superuser.com/questions/663316/can-a-printer-print-white-color.

T-Shirt Forums; Okidata Laser with White Toner; website forum; Jan. 4, 2013; 7 pages; http://www.t-shirtforums.com/laser-heat-transfer-paper/t209046.html.

Top Useful Solutions; DIY White Toner Laser Printer; website forum; Mar. 20, 2015; 4 pages; http://topusefulsolutions.com/10813/diy-white-toner-laser-printer.

Heat Press Nation; White Toner; website; 5 pages; Brea, California; http://www.heatpressnation.com/catalogsearch/result/?q=white+toner&x=0&y=0.

Inkfilling; White Toner; website forum; 2 pages; Irwindale, California; https://www.inkfilling.com/inquiries/thread_1933.html.

Alibaba; White Toner; website; Feb. 9, 2016; 2 pages; China; http://sourcing.alibaba.com/rfq_search_list.htm?fsb=y&IndexArea=rfq_en&CatId=&SearchText=white+toner.

Superuser; What will happen if i put colored toner in Black white laser printer cartridge; website forum; Jan. 20, 2010; 2 pages; http://superuser.com/questions/98147/what-will-happen-if-i-putcolored-toner-in-black-white-laser-printer-cartridge.

Superuser; Can I refill monochrome laser printer cartridge with color powder; website forum; Jan. 3, 2015; 2 pages; http://superuser.com/questions/860019/can-i-refill-monochrome-laserprinter-cartridge-with-color-powder.

Denis Cormier, et al.; Experiments in Layered Electro-Photographic Printing; manuscript; 7 pages; North Carolina State University; Raleigh, North Carolina; http://sffsymposium.engr.utexas.edu/Manuscripts/2000/2000-33-Cormier.pdf.

Graphics One; OKI pro920WT White Toner Solution; catalog; 2 pages; http://www.graphicsone.com/stage/media/catalog/product/PDFs/920%20WT%20Quick%20FAQs.pdf.

Wikipedia; Toner refill; website; Apr. 29, 2015; 3 pages; http://en.wikipedia.org/wiki/Toner_refill.

UNI-KIT; Toner Refill Instructions; manual; 142 pages; Easy Group; http://www.refillinstructions.com/tonerrefillinstructions.pdf.

GCTECH; 4 pack toner refill kit; website; Nov. 12, 2008; 6 pages; Amazon; http://www.amazon.com/Refill-LaserJet-2605DTN-Cartridges-INCLUDES/dp/B001L1A1DS.

Florent Pellegrin; Refilling method for ink jet cartridges; manual; 2007; 252 pages; Thailand; http://www.refillinstructions.com/GeneralRefill.pdf.

Walmart; Ink Refill Kit; website; 4 pages; http://www.walmart.com/c/ep/ink-refill-kit.

Alibaba; White Ink Refill; website; 8 pages; China; http://www.alibaba.com/showroom/white-ink-refill.html.

Print Country; Printer Ink Cartridges Refill Kit Troubleshooting; website; Lihua, Hawaii; 6 pages; http://www.printcountry.com/faq-troubleshooting-refill-kits.asp.

Coldesi Colman; Viper DTG Printer Training Videos—Filling Machine With Ink; video; Mar. 7, 2013; https://www.youtube.com/watch?v=sLyN8fCoy9Q.

Pantograms; Make More Money with our Stitch-n-Print Solutions Combining Embroidery With White Toner Laser Printers; website article; Tampa, Florida; 5 pages; http://www.pantograms.com/stitchnprintembroideryandheattransfers.asp.

Automatic Transfer, Inc.; White Sublimation Laser Toner; website; Alpha, New Jersey; 3 pages; http://www.atttransfer.com/whitetoner.html.

The Recycler; OKI's white toner technology wins awards; website article; Mar. 22, 2013; 2 pages; http://www.therecycler.com/posts/okis-white-toner-technology-winsawards/.

Print Planet; The 5th Toner; website forum; Apr. 6, 2012; 2 pages; http://printplanet.com/forums/digital-printing-discussion/28580-5thtoner.

Durst Tau 150 8C; High Speed Digital UV Inkject Label Press; YouTube video; Dec. 21, 2011; https://www.youtube.com/watch?v=va8KwofWDus.

(56) References Cited

OTHER PUBLICATIONS

Epson; WT7900 White Based Printing Technology; website; https://www.epson.com/cgibin/Store/jsp/Pro/SeriesStylusProWT7900/Overview.do?UseCookie=yes.
OCE; Oce White Ink Technology; website; Canon; http://global.oce.com/technologies/white-ink-technology.aspx.
Smartpress; White Ink Printing; website; http://smartpress.com/pages/white-ink-printing.
Mark Ritchie; UV White Inkjet Inks for Single-Pass Label Applications; brochure; Jan. 4, 2015; Xaar; http://www.xaar.com/en/MediaDocuments/UV-inks-white-paper.pdf.
Tshirt Forum; OKI Tabloid Printer with White Toner; website forum; May 18, 2013; http://www.t-shirtforums.com/printers-inks-inkjet-laser-transfers/t151402-12.html.
Korean Intellectual Property Office, International Search Report, dated Aug. 31, 2016, 3 pages.
Korean Intellectual Property Office, Written Opinion of the International Searching Authority, dated Aug. 31, 2016, 4 pages.
Korean Intellectual Property Office, Notification concerning Transmittal of International Preliminary Report on Patentability, dated Dec. 14, 2017, 1 page.
Korean Intellectual Property Office, International Preliminary Report on Patentability, dated Jun. 3, 2016, 5 pages.

* cited by examiner

TONER CARTRIDGE PRINTER DEVICES, SYSTEMS, AND METHODS FOR UNDER PRINTING

CROSS-REFERENCE TO RELATED APPLICATIONS

This patent application is a Continuation of U.S. Non-Provisional patent application Ser. No. 15/408,186, filed on Jan. 17, 2017, titled "Toner Cartridge Printer Devices, Systems, and Methods for Over Printing and Under Printing", by co-inventors Michael Raymond Josiah and Joseph Dovi, the contents of which are expressly incorporated herein by this reference as though set forth in their entirety and to which priority is claimed. U.S. Non-Provisional patent application Ser. No. 15/408,186 is a Continuation-in-Part of U.S. Non-Provisional patent application Ser. No. 15/286,875, filed on Oct. 6, 2016, titled "Method and System for Converting a Toner Cartridge Printer to a Metallic, Clear Fluorescent, or Light Toner Printer", by co-inventors Michael Raymond Josiah and Joseph Dovi, the contents of which are expressly incorporated herein by this reference as though set forth in their entirety and to which priority is claimed. U.S. Non-Provisional patent application Ser. No. 15/286,875 is a Continuation-in-Part of U.S. Non-Provisional patent application Ser. No. 14/879,548, filed on Oct. 9, 2015, titled "Method and System for Converting a Toner Cartridge Printer to a White, Clear, or Fluorescent Toner Printer", by co-inventors Michael Raymond Josiah and Joseph Dovi, the contents of which are expressly incorporated herein by this reference as though set forth in their entirety and to which priority is claimed. U.S. Non-Provisional patent application Ser. No. 14/879,548 is a Continuation-in-Part of U.S. Non-Provisional patent application Ser. No. 14/731,785, filed on Jun. 5, 2015, titled "Method and System for Converting a Toner Cartridge Printer to a White Toner Printer," by co-inventors Michael Raymond Josiah and Joseph Dovi, the contents of which are expressly incorporated herein by this reference as though set forth in their entirety and to which priority is claimed.

FIELD OF USE

The present disclosure relates generally to toner cartridge printers that are able to both under print and over print, and more specifically, to devices, systems, and methods of providing a toner printer that can over print and under print in a single pass, and/or converting a standard toner cartridge printer to a printer that prints with white toner on under or over printing in a single pass.

BACKGROUND

Before the present disclosure, toner printers were unable to over print and under print in a single pass. This is desirable because in order to accomplish both under printing and overprinting, a user would have to purchase two different machines or systems. Under printing is beneficial because it allows printing on a darker media without having the colors of the print job be washed out by the darker media. Over printing is beneficial because it allows for a heat transfer print operation to a darker media without having the colors of the print job be washed out by the darker media.

Furthermore, before the present disclosure, there existed toner printers that could under print in a single pass, and toner printers that could over print in a single pass, but there existed no machines that could over or under print in a single pass. Typically, the over print must be done after laying down the color print job, which is two passes. The under print must be done before laying down the color print job, which is also in two passes.

Thus, there is a need for device, system, and method for providing or converting a toner cartridge printer that can over or under print in a single pass. Preferably, the device, system, and method allows for a single machine or system be capable to interchange from over printing to under printing and vice-versa.

SUMMARY OF EMBODIMENTS

To minimize the limitations in the cited references, and to minimize other limitations that will become apparent upon reading and understanding the present specification, the toner cartridge printer devices, systems, and methods disclosed herein preferably allow a user to convert a standard printer into one that prints using white, metallic gold, metallic silver, light magenta, or light cyan toner.

It is an object of the present system and method for converting a standard CMYK toner cartridge printer into a CMYX toner cartridge printer, where the X is a non-standard color, such as white, clear, metallic, security, ceramic, and/or clear fluorescent.

It is an object of the present system to overcome the limitations of the prior art.

It is an object of the present device, system, and method for converting a standard CMYK toner cartridge printer into CMYW. This conversion can be done with or without raster image processor (RIP) software. When used in conjunction with raster image processor software, the CMYW printer may be able to under print in white, print spot white, and print in black by using the CMY colors.

One embodiment may be a method of converting a standard CMYK color toner printer to a CMYW toner printer, comprising the steps: providing a standard CMYK color toner printer, comprising four toner printing cartridges: a cyan toner printing cartridge, a magenta toner printing cartridge, a yellow toner printing cartridge, and a black toner printing cartridge; wherein the black toner printing cartridge is in a first toner printing cartridge position; removing the black toner printing cartridge from the standard CMYK color toner printer, such that the first toner printing cartridge position is empty; providing a white toner printing cartridge; installing the white toner printing cartridge into the first toner printing cartridge position, such that the standard CMYK color toner printer is now a CMYW toner printer; and wherein the standard CMYK color toner printer lacks a raster imaging processor software, such that the CMYW toner printer does not distinguish the white toner printing cartridge from the black toner printing cartridge, such that the CMYW toner printer prints white rather than black. The white toner printing cartridge may comprise a printing cartridge chip that allows the CMYK color toner printer to recognize the white toner printing cartridge as an acceptable toner printing cartridge when the white toner printing cartridge is installed into the CMYK color toner printer.

Another embodiment may be a method of converting a CMYK color toner printer to a CMYX color toner printer for under print printing in a single pass, comprising the steps: providing a color toner printer with four toner printing cartridges: a cyan toner printing cartridge, a magenta toner printing cartridge, a yellow toner printing cartridge, and a black toner printing cartridge; wherein the black toner printing cartridge is in a first toner cartridge position; removing the back toner printing cartridge from the first toner cartridge position; providing a non-standard toner printing cartridge; installing the non-standard toner printing cartridge into the first toner cartridge position; providing a raster image processor software; wherein the raster image processor software is configured to remap the four toner printing cartridges of the color toner printer and allows the color toner printer to print a layer of non-standard toner under an image in a single pass; and wherein the image is printed from at least one of a cyan toner, a yellow toner, and a magenta toner. The non-standard toner printing cartridge may comprise a chip that allows the non-standard toner printing cartridge to be recognized by the color toner printer. The non-standard toner printing cartridge may be selected from the group of non-standard toner printing cartridges consisting of: white; clear; and clear fluorescent. The raster image processor software may be further configured to allow the color toner printer to spot print with the non-standard toner printing cartridge. The raster image processor software may be further configured to allow the color toner printer to print black by using, in combination, the cyan toner, the magenta toner, and the yellow toner. The raster image processor software may comprise at least one feature selected from the group of features consisting of: removing one or more colors from the image to be printed; changing one or more colors of the image; reducing an amount of toner used to print the image; reducing an amount of non-standard toner used to print under the image; increasing the amount of toner used to print the image; increasing the amount of non-standard toner used to print under the image; rasterizing the image; and providing a cost calculation for printing the image. The method may further comprise the step: printing the image, such that the image may be printed above the layer of non-standard toner in a single pass. The method may further comprise the steps: removing the non-standard toner printing cartridge from the first toner cartridge position; removing the cyan toner printing cartridge from a fourth toner cartridge position; installing the cyan toner printing cartridge into the first toner cartridge position; installing the non-standard toner printing cartridge into the fourth toner cartridge position; remapping with the raster image processor software the four toner printing cartridges of the color toner printer, such that the color toner printer is configured to print a new layer of non-standard toner over a second image in a single pass; wherein the second image is printed from at least one of: a cyan toner, a yellow toner, and a magenta toner. The method may further comprise the step: printing the image, such that the image is printed beneath the layer of the non-standard toner in a single pass.

Another embodiment may be a method of converting a CMYK color toner printer to a CMYX color toner printer for over print printing in a single pass, comprising the steps: providing a color toner printer, comprising four toner printing cartridges: a cyan toner printing cartridge, a magenta toner printing cartridge, a yellow toner printing cartridge, and a black toner printing cartridge; removing the black toner printing cartridge from a first toner cartridge position; removing the cyan toner printing cartridge from a fourth toner cartridge position; providing a non-standard toner printing cartridge; installing the cyan toner printing cartridge into the first toner cartridge position; installing the non-standard toner printing cartridge into the fourth toner cartridge position; providing a raster image processor software; wherein the raster image processor software is configured to remap the four toner printing cartridges of the color toner printer and allows the color toner printer to print a layer of non-standard toner over an image in a single pass; wherein the image is printed from at least one of: a cyan toner, a yellow toner, and a magenta toner. The non-standard toner printing cartridge may comprise a chip that allows the color toner printer to recognize the non-standard toner printing cartridge. The non-standard toner printing cartridge may be selected from the group of non-standard toner printing cartridges consisting of: white; clear; and clear fluorescent. The raster image processor software may be further configured to allow the color toner printer to spot print with the non-standard toner printing cartridge. The raster image processor software may be further configured to allow the color toner printer to print black by using, in combination, the cyan toner, the magenta toner, and the yellow toner. The raster image processor software may be further configured to comprise at least one of the features selected from the group of features consisting of: removing one or more colors from the image to be printed; changing one or more colors in the image; reducing an amount of toner used to print the image; reducing an amount of non-standard toner used to print under the image; increasing the amount of toner used to print the image; increasing the amount of non-standard toner used to print over the image; rasterizing the image; and providing a cost calculation for printing the image. The method may further comprise the step: printing the second image, such that the second image is printed beneath the new layer of non-standard toner in a single pass. The method may further comprise the steps: removing the non-standard toner printing cartridge from the fourth toner cartridge position; removing the cyan toner printing cartridge from the first toner cartridge position; installing the non-standard toner printing cartridge into the first toner cartridge position; installing the cyan toner printing cartridge into the fourth toner cartridge position; remapping with the raster image processor software the four toner printing cartridges of the color toner printer, such that the color toner printer is configured to print a new layer of non-standard toner under a second image in a single pass; wherein the second image is printed from at least one of: a cyan toner, a yellow toner, and a magenta toner. The method may further comprise the step: printing the second image, such that the second image is printed above of the new layer of non-standard toner in a single pass.

Other features and advantages inherent in the system and method for converting a standard toner cartridge printer into white, metallic, fluorescent, or light toner printer claimed and disclosed will become apparent to those skilled in the art from the following detailed description and its accompanying drawings.

BRIEF DESCRIPTION OF THE DRAWINGS

The drawings are of illustrative embodiments. They do not illustrate all embodiments.

Other embodiments may be used in addition or instead. Details which may be apparent or unnecessary may be omitted to save space or for more effective illustration. Some embodiments may be practiced with additional components or steps and/or without all of the components or steps, which are illustrated. When the same numeral appears in different drawings, it refers to the same or like components or steps.

DETAILED DESCRIPTION OF THE ILLUSTRATIVE EMBODIMENTS

In the following detailed description, numerous specific details are set forth in order to provide a thorough understanding of various aspects of one or more embodiments. However, these embodiments may be practiced without some or all of these specific details. In other instances, well-known methods, procedures, and/or components have not been described in detail so as not to unnecessarily obscure aspects of embodiments.

While multiple embodiments are disclosed, still other embodiments will become apparent to those skilled in the art from the following detailed description. As will be realized, these embodiments are capable of modifications in various obvious aspects, all without departing from the spirit and scope of protection. Accordingly, the screen shots, figures, and the detailed descriptions thereof, are to be regarded as illustrative in nature and not restrictive. Also, the reference or non-reference to a particular embodiment shall not be interpreted to limit the scope of protection.

The present specification discloses systems and methods for converting a toner cartridge printer to a white, metallic, fluorescent, or light toner printer. The methods and systems for converting a toner cartridge printer to a white, metallic, fluorescent, or light toner printer preferably require no special or dedicated printer drivers.

In the following description, certain terminology is used to describe certain features of one or more embodiments. For purposes of the specification, unless otherwise specified, the term "printing cartridge(s)" generally refers to a toner cartridge, a laser toner cartridge, a LED toner cartridge, a drum cartridge, and/or a combined toner and drum cartridge.

As used herein, the term "toner" generally refers to a powder, particulate, or dry ink that is used in laser printers, printers, and printing machines to form the printed text and images on the medium being printed. Generally, toner particles are melted by the heat of a fuser, and bound to the media.

Regarding a CMYW printer, the letter "W" preferably stands for white but may also be refer to a non-standard toner or toner color, such as white, clear, clear fluorescent, metallic, ceramic, and/or security.

Regarding a CMYX printer, the letter "X" may refer to a non-standard color, such as white, clear, clear fluorescent, metallic, ceramic, and/or security.

Figure 1:
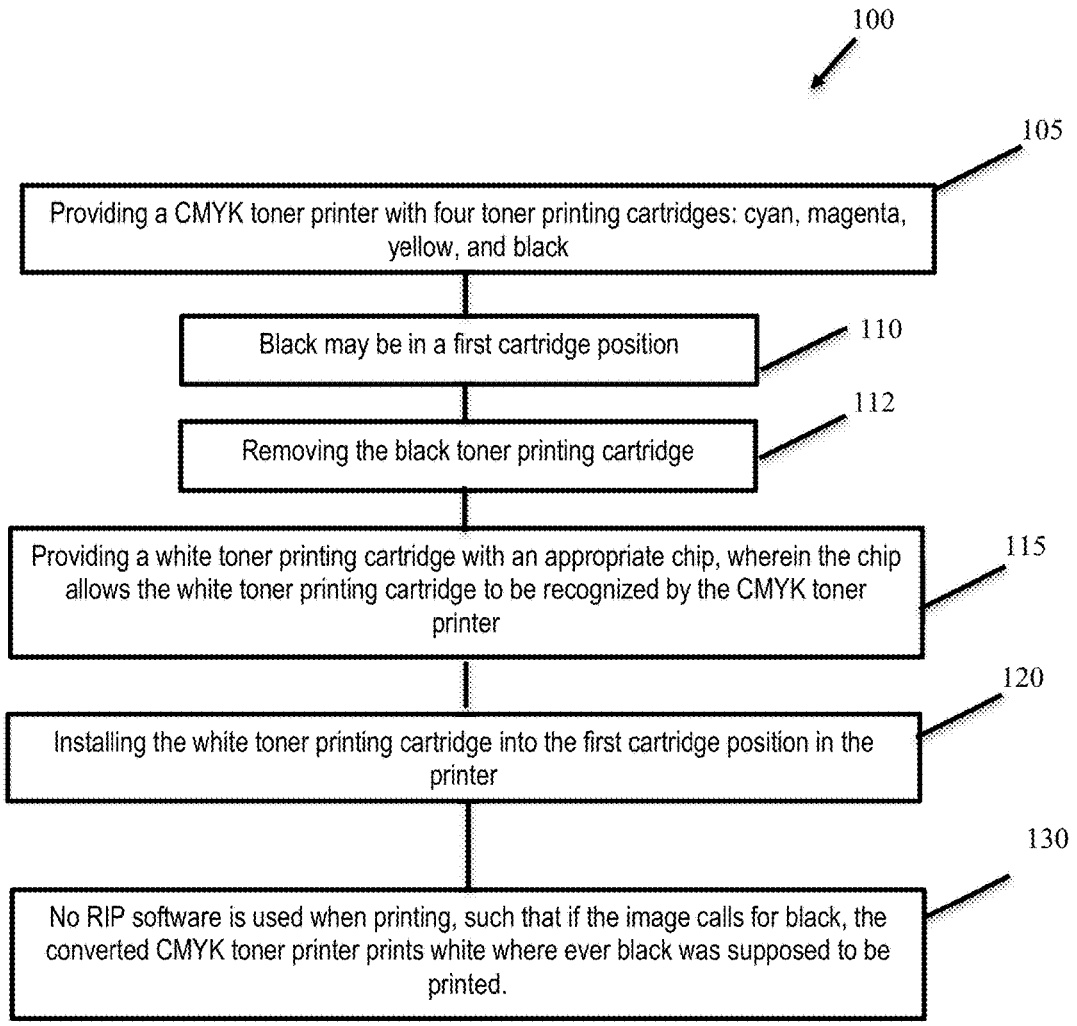
FIG. 1 is a flow block diagram of one embodiment of the method of converting a CMYK printer to a CMYW printer.

FIG. 1 is a flow block diagram of one embodiment of the method of converting a CMYK printer to a CMYW printer. As shown in FIG. 1, the first step of the method 100 may be providing a standard CMYK color toner printer, which may comprise four toner printing cartridges: cyan, magenta, yellow, and black 105. This method is generally applicable with printers that (1) have printing cartridges that are dual drums and toner cartridges or (2) have separate drum and toner cartridges for each color. If used with printers having separate cartridges, then both cartridges may be removed and/or replaced. Typically, the black toner printing cartridge may be in the first position 110, and may later be removed 112. The black toner printing cartridge may be (1) reserved for later swapping back into the printer, (2) refilled for later use, (3) recycled (if completely empty), and/or (4) cleaned and filled with a different color and then used. The next step 115 may be providing a white toner printing cartridge. This cartridge may comprise a cartridge chip that allows the printer to recognize the white toner printing cartridge as an acceptable cartridge after installed into the first cartridge position 120. Preferably, the printer recognizes the white toner printing cartridge as black. Thus, because no raster image processor software is used when printing, the now converted CMYK toner printer preferably prints white in areas where black is to be printed.

Figure 2:
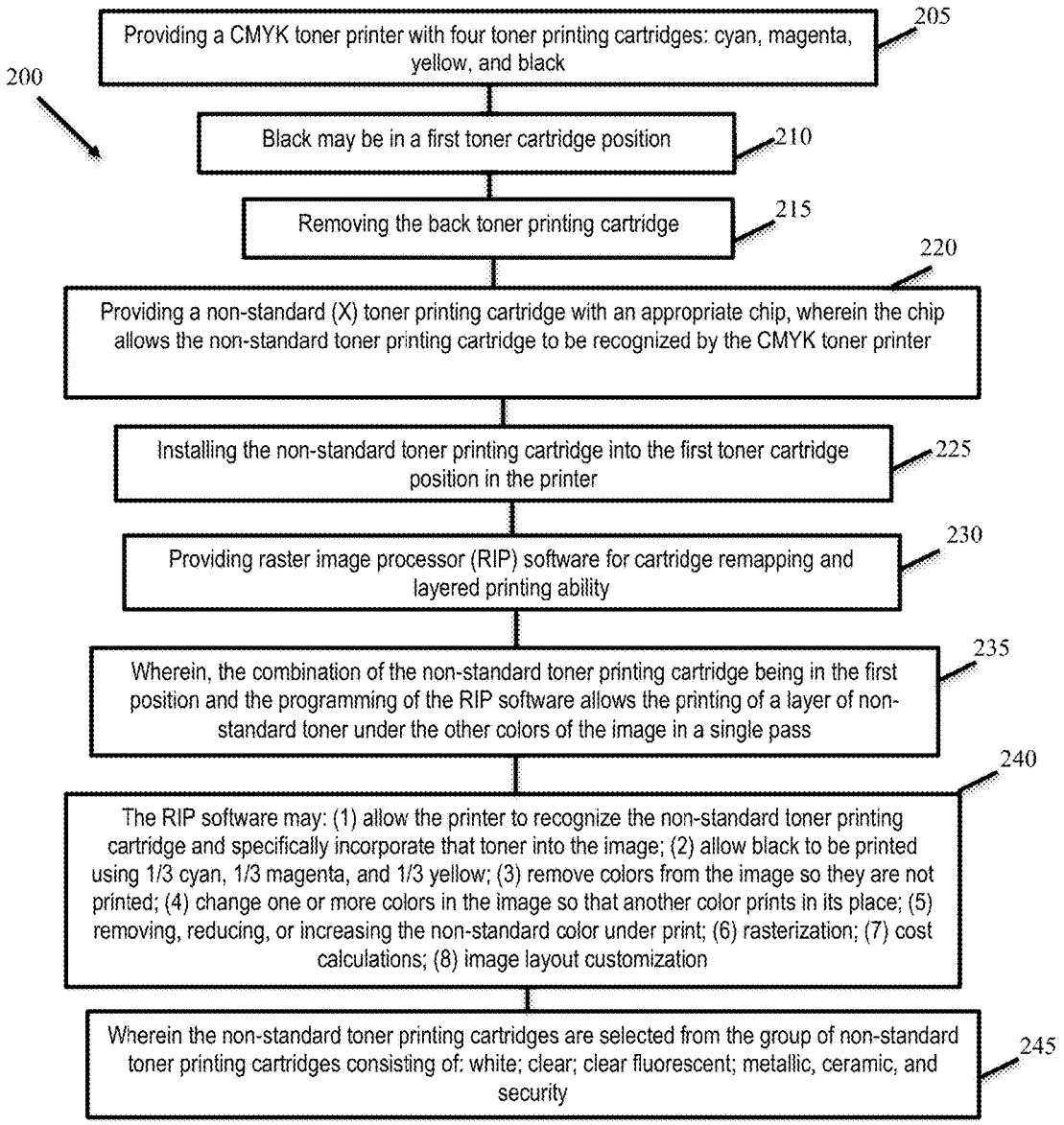
FIG. 2 is a flow block diagram of one embodiment of the method of converting a CMYK printer to a CMYX printer for under printing in one pass.

FIG. 2 is a flow block diagram of one embodiment of the method of converting a CMYK printer to a CMYX printer for under printing in one pass. The first step of method 200 may be providing a CMYK toner printer with four toner printing cartridges: cyan, magenta, yellow, and black 205, wherein black may be in a first toner cartridge position 210; removing the back toner printing cartridge 215; providing a non-standard (X) toner printing cartridge with an appropriate chip, wherein the chip allows the non-standard toner printing cartridge to be recognized by the CMYK toner printer 220; installing the non-standard toner printing cartridge into the first toner cartridge position in the printer 225; and providing raster image processor (RIP) software for cartridge remapping and layered printing ability 230, wherein, the combination of the non-standard toner printing cartridge being in the first position and the programming of the RIP software may allow the user to print a layer of non-standard toner under the other colors of the image in a single pass 235. The RIP software may: (1) allow the printer to recognize the non-standard toner printing cartridge and may specifically incorporate that toner into the image; (2) allow black to be printed using ⅓ cyan, ⅓ magenta, and ⅓ yellow; (3) remove colors from the image so that the colors are not printed; (4) change one or more colors in the image so that another color prints in its place; (5) removing, reducing, or increasing the non-standard color under print; (6) rasterization; (7) cost calculations; (8) image layout customization 240. The non-standard toner printing cartridges may be selected from the group of non-standard toner printing cartridges consisting of: white; clear; clear fluorescent; metallic, ceramic, and security 240.

Figure 3:
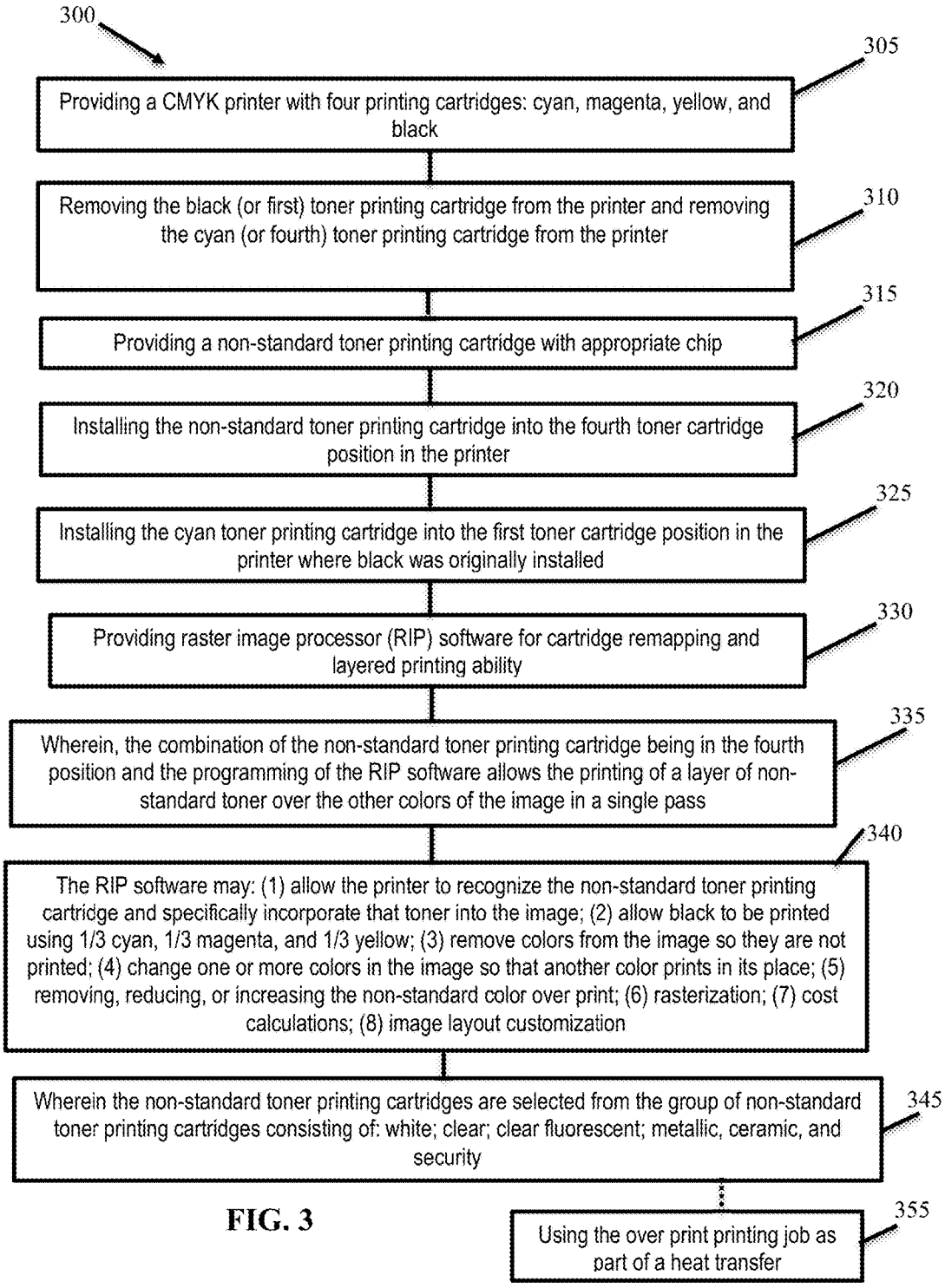
FIG. 3 is a flow block diagram of one embodiment of the method of converting a CMYK printer to a CMYX printer for over printing in one pass.

FIG. 3 is a flow block diagram of one embodiment of the method of converting a CMYK printer to a CMYX printer for over printing in a single pass. The method 300 may comprise the steps: providing a CMYK printer with four printing cartridges: cyan, magenta, yellow, and black 305; removing the black (or first) toner printing cartridge from the printer (the first toner cartridge position) and removing the cyan (or fourth) toner printing cartridge from the printer (the fourth toner cartridge position) 310; providing a non-standard toner printing cartridge with the appropriate chip 315; installing the non-standard toner printing cartridge into the fourth toner cartridge position in the printer 320; installing the cyan toner printing cartridge into the first toner cartridge position in the printer where the black toner printing cartridge was originally installed (this may be the same removed cyan toner printing cartridge or a new one 325); and providing raster image processor (RIP) software for cartridge remapping and layered printing ability 330. Preferably, the combination of the non-standard toner printing cartridge being in the fourth position and the programming of the RIP software may allow the user to print a layer of non-standard toner over the other colors of the image in a single pass 335. The RIP software may: (1) allow the printer to recognize the non-standard toner printing cartridge and may specifically incorporate that toner into the image; (2) allow black to be printed using ⅓ cyan, ⅓ magenta, and ⅓ yellow; (3) remove colors from the image so they are not printed; (4) change one or more colors in the image so that another color prints in its place; (5) removing, reducing, or increasing the non-standard color over print; (6) rasterization; (7) cost calculations; (8) image layout customization 340. Preferably, the non-standard toner printing cartridges are selected from the group of non-standard toner printing cartridges consisting of: white; clear; clear fluorescent; metallic, ceramic, and security 345. Using the over print printing job as part of a heat transfer 355.

Figure 4:
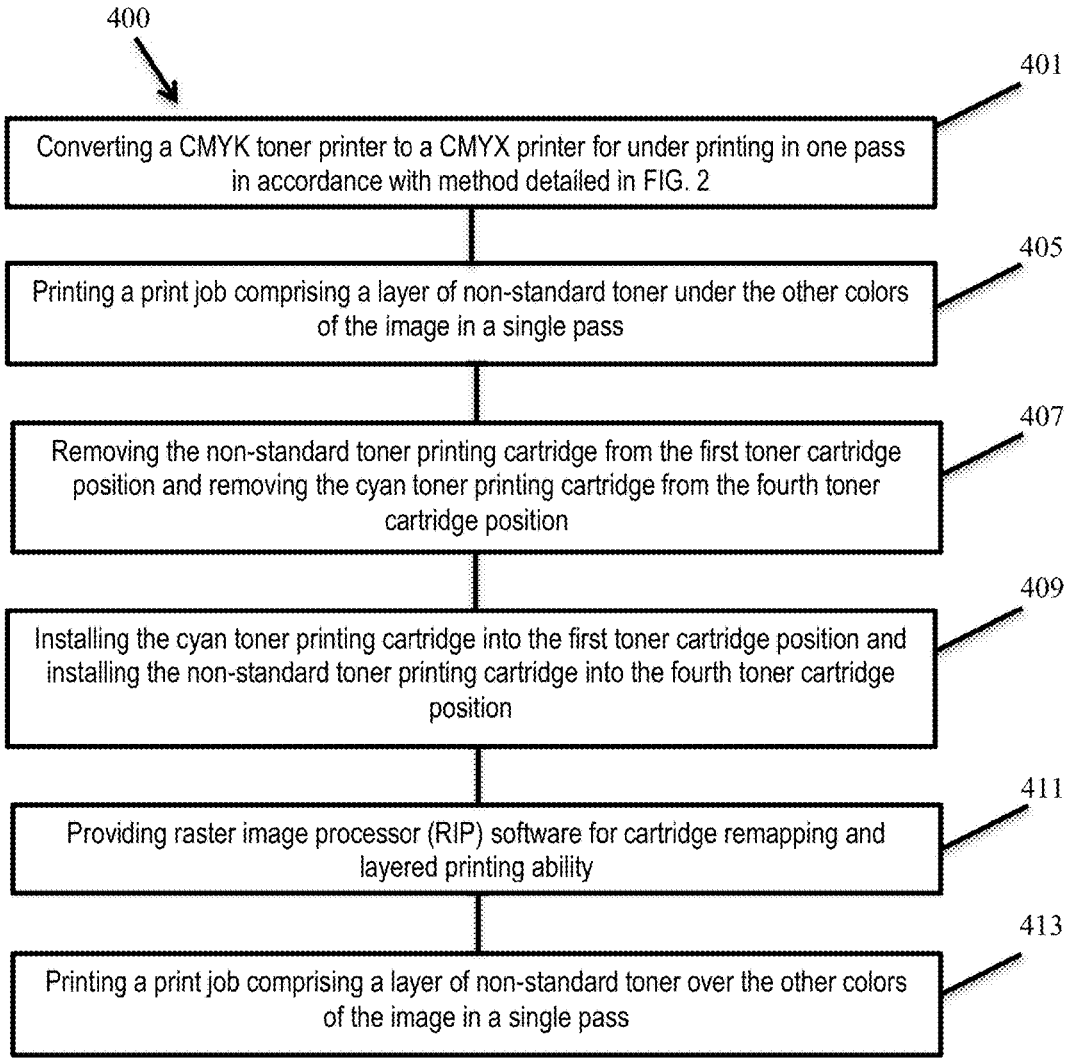
FIG. 4 is a flow block diagram of one embodiment of the method of converting a CMYX printer configured to under print to a CMYX printer configured to over print.

FIG. 4 is a flow block diagram of one embodiment of the method of converting a CMYX printer configured to under print to a CMYX printer configured to over print. The method 400 may begin with the first step of converting a CMYK toner printer to a CMYX printer for under printing in a single pass in accordance with method detailed in FIG. 2 401. To show that the printer is appropriately converted, the method 400 may comprise the step of printing a print job comprising a layer of non-standard toner beneath the other colors of the image in a single pass 405. The remainder of the steps may comprise: removing the non-standard toner printing cartridge from the first toner cartridge position and removing the cyan toner printing cartridge from the fourth toner cartridge position 407; installing the cyan toner printing cartridge into the first toner cartridge position and installing the non-standard toner printing cartridge into the fourth toner cartridge position 409; providing raster image processor (RIP) software for cartridge remapping and layered printing ability 411; and printing a print job comprising a layer of non-standard toner over the other colors of the image in a single pass 413.

Figure 5:
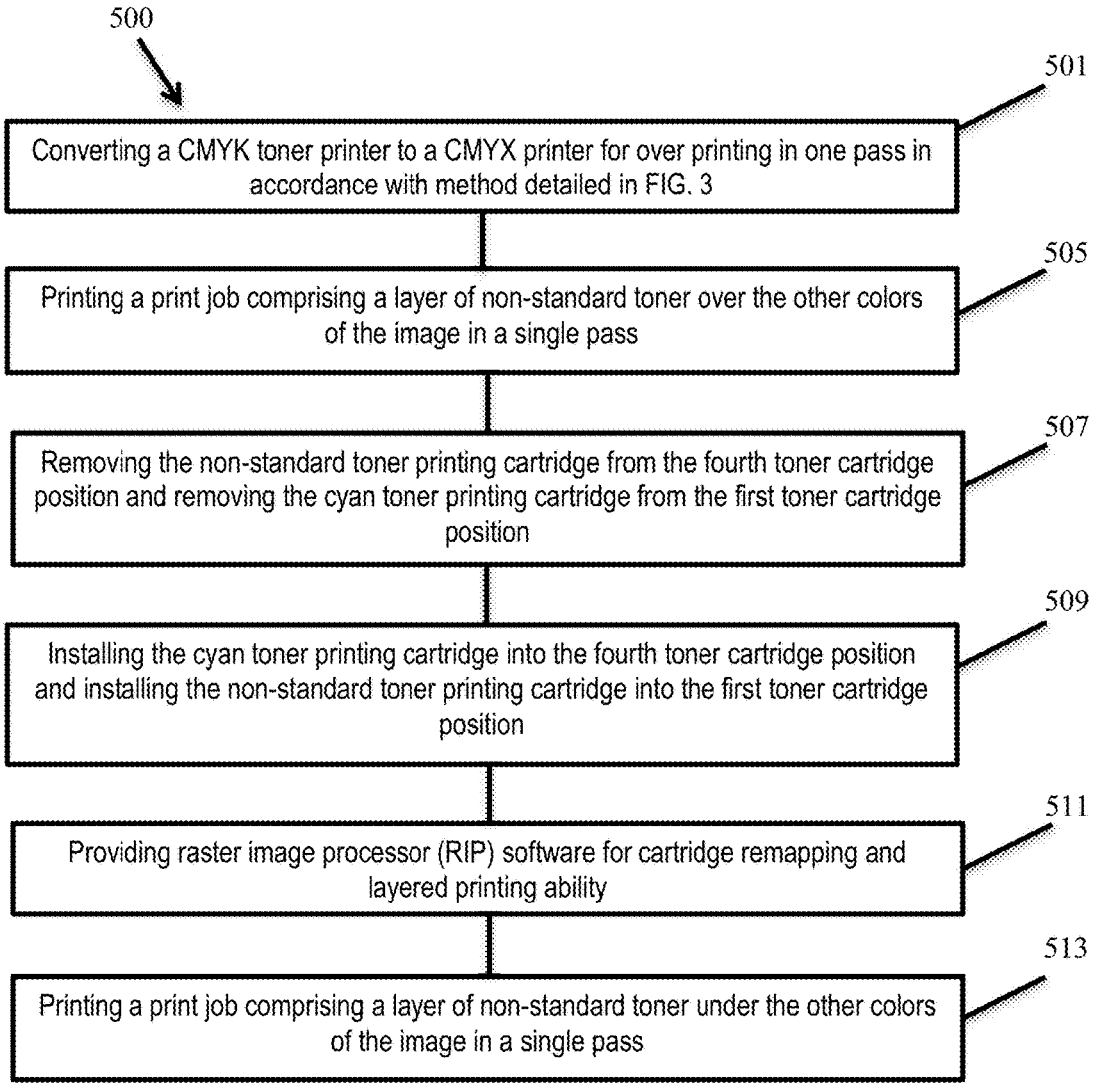
FIG. 5 is a flow block diagram of one embodiment of the method of converting a CMYX printer configured to over print to a CMYX printer configured to under print.

FIG. 5 is a flow block diagram of one embodiment of the method of converting a CMYX printer configured to over print to a CMYX printer configured to under print. The method 500 may comprise the steps of: converting a CMYK toner printer to a CMYX printer for over printing in a single pass in accordance with method detailed in FIG. 3 501; printing a print job comprising a layer of non-standard toner over the other colors of the image in a single pass 505; removing the non-standard toner printing cartridge from the fourth toner cartridge position and removing the cyan toner printing cartridge from the first toner cartridge position 507; installing the cyan toner printing cartridge into the fourth toner cartridge position and installing the non-standard toner printing cartridge into the first toner cartridge position 509; providing raster image processor (RIP) software for cartridge remapping and layered printing ability 511; and printing a print job, comprising a layer of non-standard toner beneath the other colors of the image in a single pass.

Figure 6:
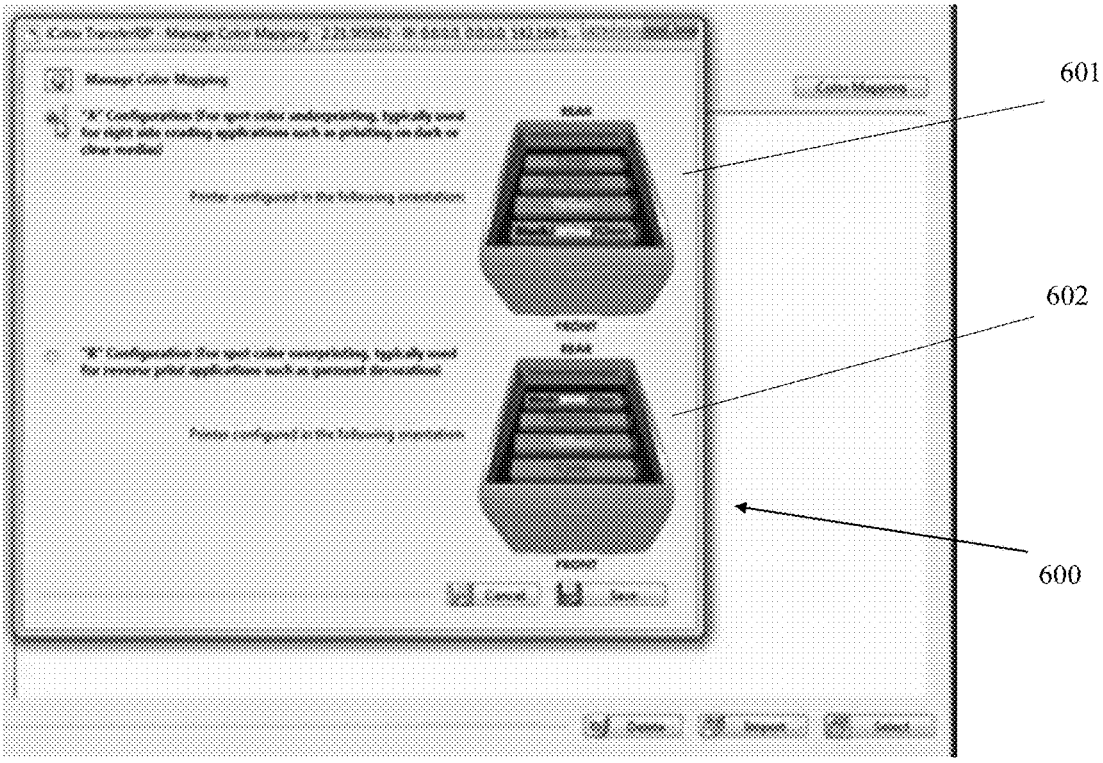
FIG. 6 is an illustration of a screen capture of the RIP software and shows the user selecting the user selecting between the over print printing and under print printing configurations.

FIG. 6 is an illustration of a screen capture of the RIP software and shows the user selecting between the over print printing and under print printing configurations. Preferably, the user first physically arranges the toner printing cartridges in the printer for the ability to over print or under print in a non-standard toner. As shown in FIG. 6, one embodiment of the screen RIP software may comprise a selection screen 600, which may allow the user to select the over or under print configurations. FIG. 6 shows that the non-standard toner may be white or clear, and if under print printing (or underprinting), the white toner may be in the first toner cartridge position 601. If over print printing (or overprinting), the white or clear toner may be in the fourth or last toner cartridge position 602. The RIP software may be configured to run on a computer that interfaces with the toner printer via wire or wireless connection. Once the user selects over printing 602 or under printing 601, the RIP software has effectively remapped the printer so that the printer recognizes that the user has installed a non-standard toner cartridge and the printer can print using this non-standard color.

The RIP software may allow printer to spot print with the non-standard color installed in either the first or fourth position. Selecting a white under print may be beneficial if the media being printed on is clear or if white would improve the contrast.

When the white or non-standard toner is in the first toner cartridge position the white toner prints first on the substrate, paper, or other media with which the printer engages and prints on. The RIP software controls the printer and allows the printer to first put down a layer of white, upon which the other colors may print on top of contemporaneously. In this manner the image to be printed is printed with an under layer of white all in only a single pass of the printer.

When the white or non-standard toner is in the fourth toner cartridge position, the white toner may print last on the substrate, paper, or other media with which the printer engages and prints on. The RIP software may allow the printer to first put down the color image and then contemporaneously put a layer of white on top of the color layer all in a single pass of the printer.

FIG. 6 also shows how the printer, after first under print printing, may then be reconfigured to over print with a non-standard toner. FIG. 6 also shows how the printer, after first over print printing, may then be reconfigured to under print with a non-standard toner. Prior to the present disclosure, no printer has ever been able to be configured to print using both methods.

Although the printer, as configured to print for over print or under print printing, does not have a black toner cartridge, the RIP software may allow black to be printed by using ⅓ cyan, ⅓ magenta, and ⅓ yellow. In this manner, the user preferably does not lose functionality of printing black. Indeed, the RIP software is programmed with standard color profiles of the International Color Consortium, which allows the printer to utilize the standard and non-standard toner printing cartridges to make any color required for the printing job.

Other features that of the RIP software may include: removing colors from the image so they are not printed; changing or one or more colors in the image so that another color prints in its place (swapping); removing, reducing, or increasing the non-standard color over/under print; rasterization; cost calculations; and image layout customization.

Figure 7:
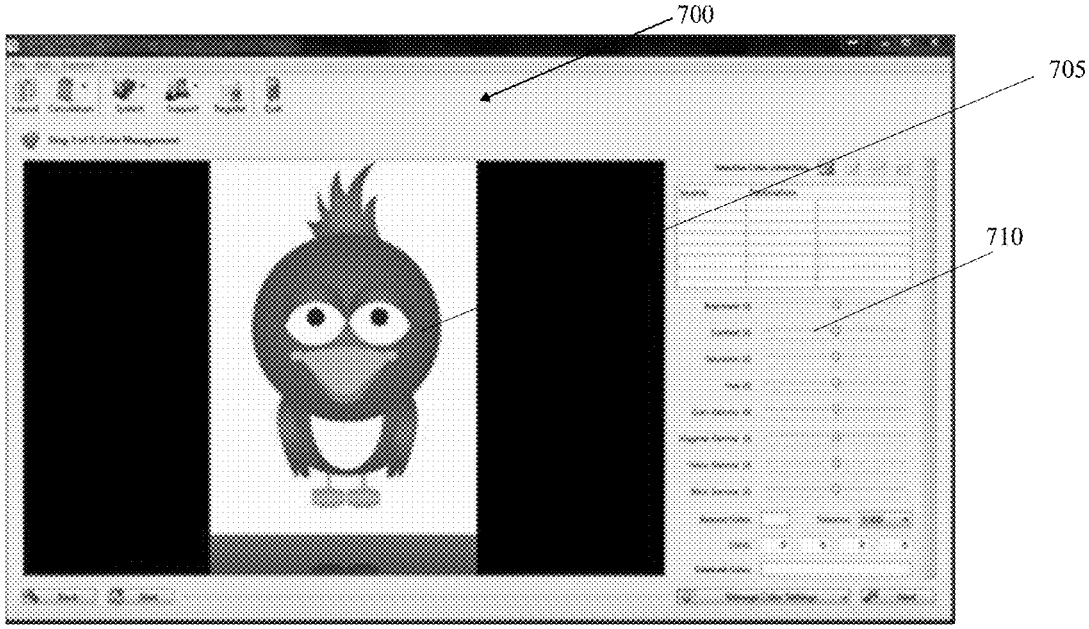
FIG. 7 shows the graphical user interface color management screen of the RIP software, wherein image has been loaded.

FIG. 7 shows the graphical user interface color management screen 700 of the RIP software, wherein image 705 has been loaded. The user may use the controls 710 to manipulate the colors and toner usage of the image.

Figure 8:
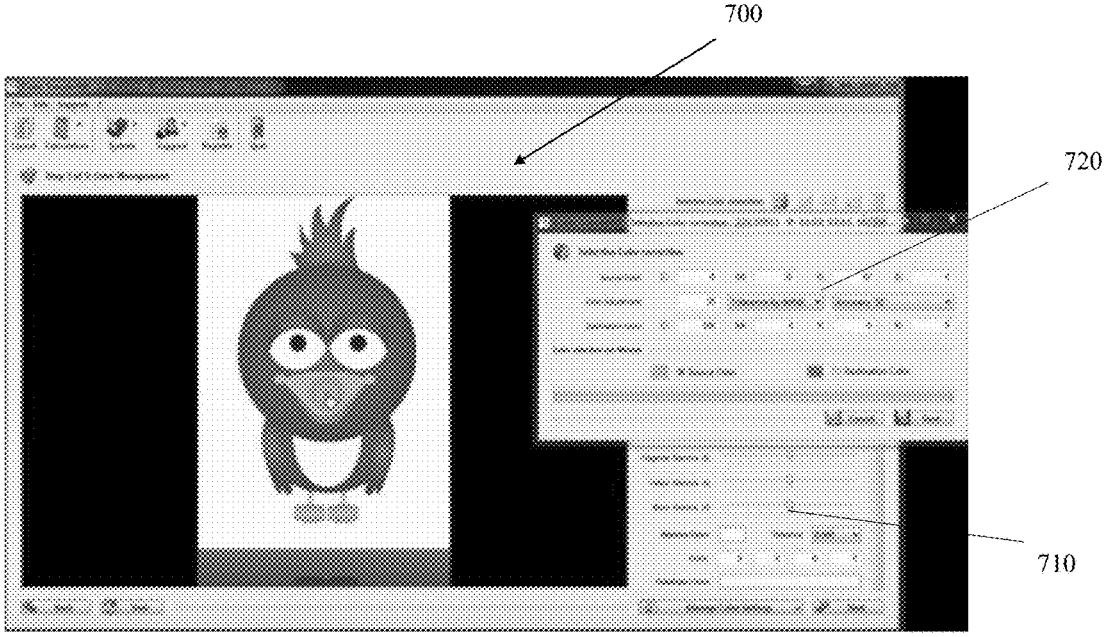
FIG. 8 shows the graphical user interface color management screen of the RIP software, wherein a color correction is being made.

FIG. 8 shows the graphical user interface color management screen 700 of the RIP software, wherein a color correction is being made. The user may bring up color correction screen 720 in order to change the yellow parts of image 705 from yellow to blue. The correction screen 720 may allow the user to manipulate precisely which colors to change, what the new color will be, and preview the color change.

Figure 9:
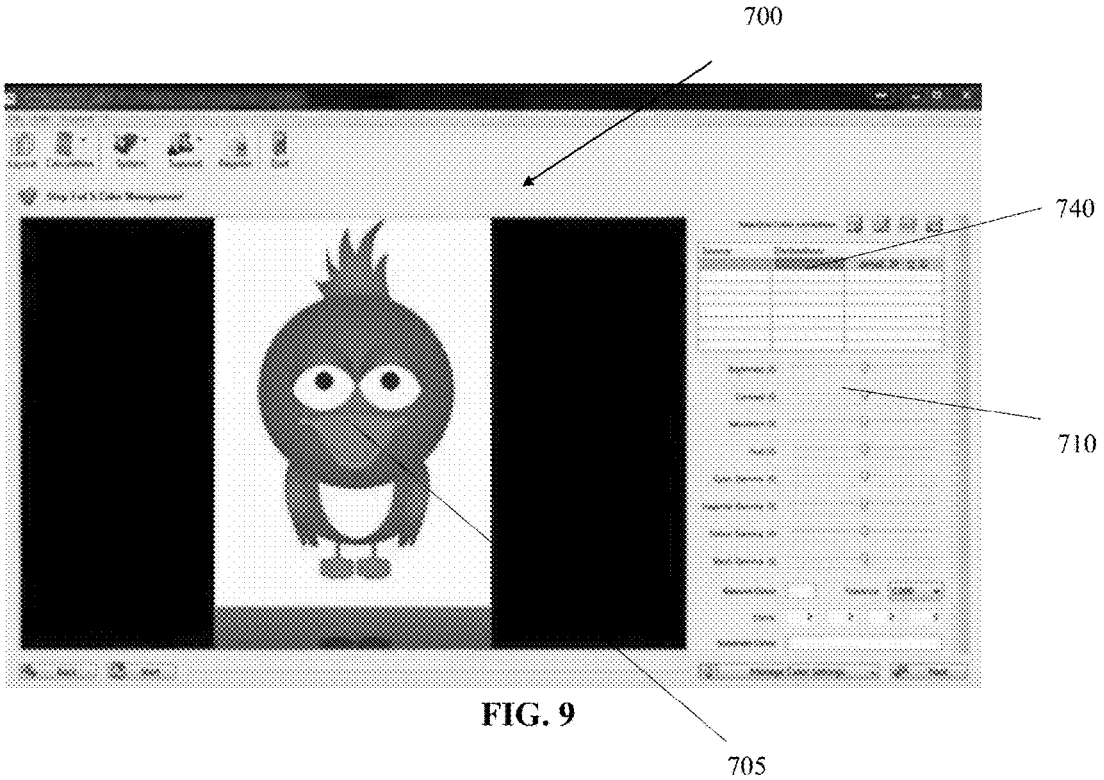
FIG. 9 shows the graphical user interface color management screen of the RIP software, wherein a color correction has been made.

FIG. 9 shows the graphical user interface color management screen 700 of the RIP software, wherein a color correction has been made. FIG. 9 shows that the beak and fee of bird image 705 are not blue, not yellow. The chart 740 shows the colors that have been changed on the image 705. When printed, those parts will now preferably print in blue. Any color may be swapped for another color and the colors may be switched back. The RIP software may also allow for simple changes in brightness, contrast, saturation, hue, CMYK levels, remove unwanted colors, and to change the background color to see what images looks like on a particular substrate. This also makes it easier to visualize what the image will look like after transference.

An unwanted color might be one that is the same color as the substrate to be printed on. For example, if the printing of image 705 was on a black background, the black pupils of the bird's eye can be removed, so that the pupils do not print at all. The pupils may remain black and visible on the final printout because the substrate on which the image is printed on is black.

Figure 10:
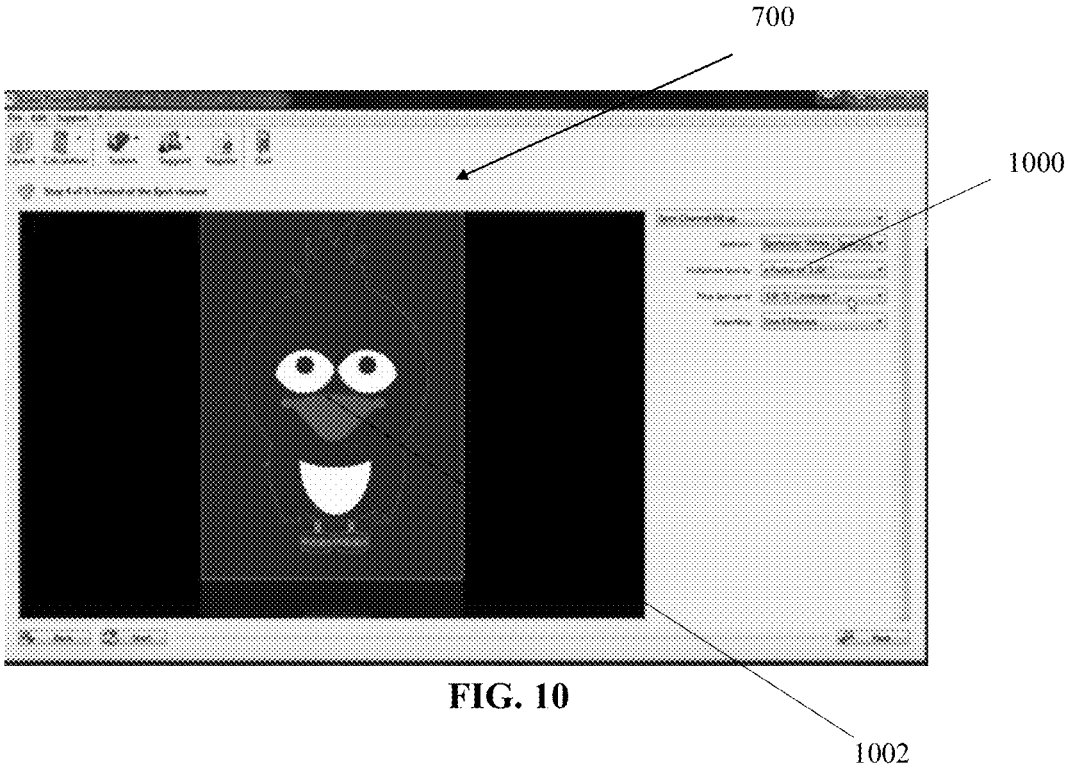
FIG. 10 shows the graphical user interface color management screen of the RIP software, wherein the under or over print toner printing may be manipulated.

FIG. 10 shows the graphical user interface color management screen 700 of the RIP software, wherein the under or over print toner printing may be manipulated. FIG. 10 shows that the spot channel fill-up screen 1000 may allow the user to set the amount of under or over printing of the non-standard toner. FIG. 10 shows a low amount of underfilling 1002.

Figure 11:
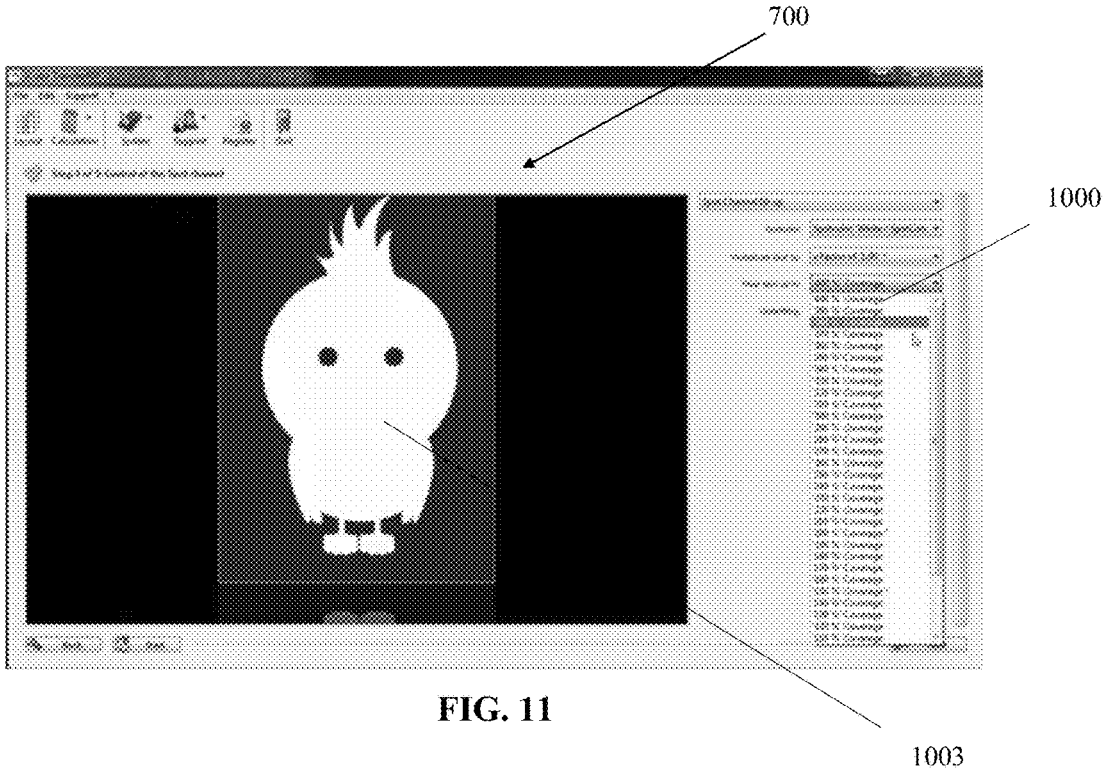
FIG. 11 shows the graphical user interface color management screen of the RIP software, wherein there is a high amount of under filing.

FIG. 11 shows the graphical user interface color management screen 700 of the RIP software, wherein there is a high amount of underfilling. The channel fill-up screen 1000 may allow the user to set a high amount of underfilling 1003. The higher the amount of non-standard toner used, the greater the foot print and the more visible the non-standard toner will be. A lot of white under print may create a halo of white around the image, whereas a low amount of white under print may make the under file not visible on the image.

Figure 12:
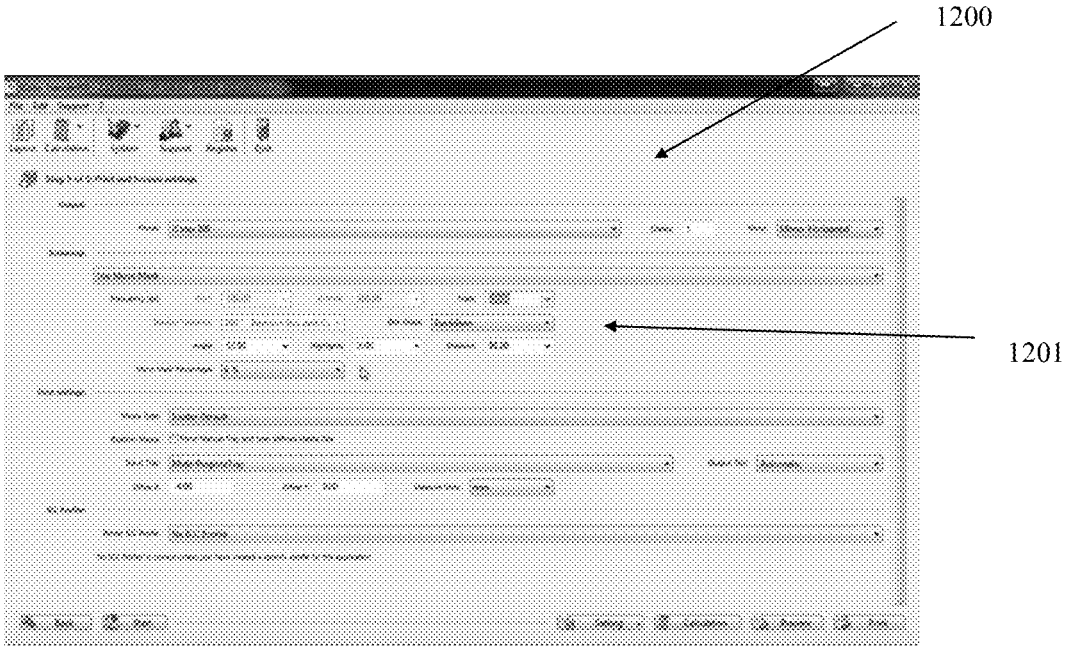
FIG. 12 shows the final print set-up screen of the RIP software.

FIG. 12 shows the final print set-up screen 1200 of the RIP software. The screening portion 1202 of the screen 1200 allows the user to Rasterize the image, which allows the user to print the image with a plurality of holes covering a specific percentage of the image.

Figure 13:
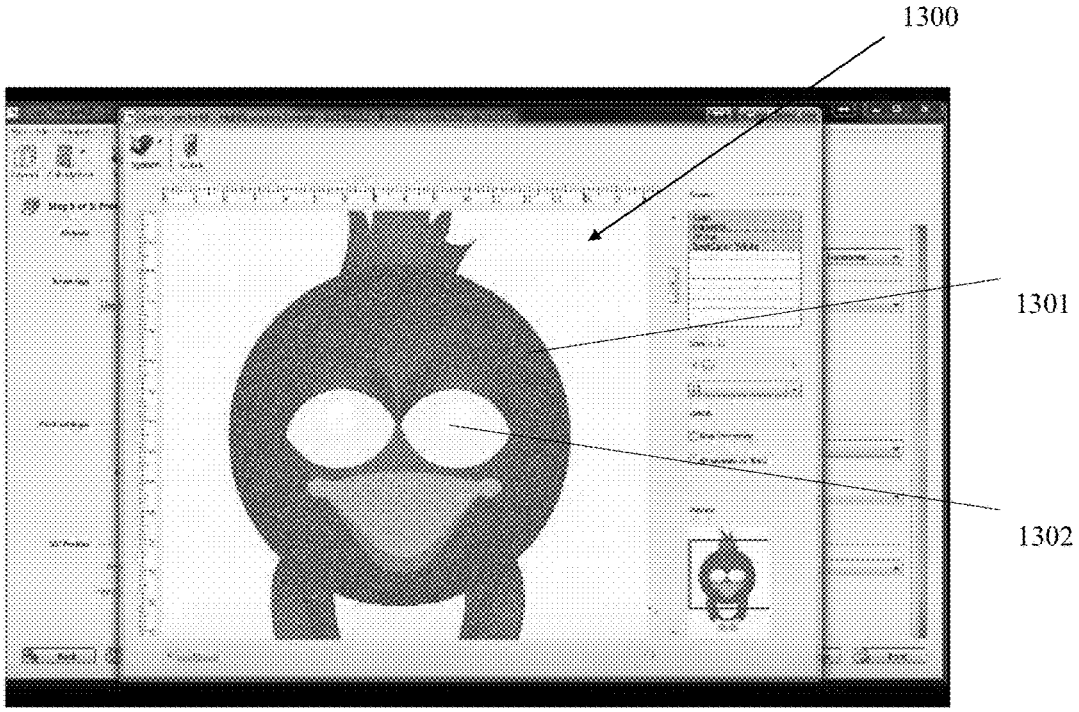
FIG. 13 shows the rasterization zoom screen.

FIG. 13 shows the rasterization zoom screen 1300. FIG. 13 shows a magnified image that allows the user to see how the holes 1301 will print on the image. FIG. 13 also shows that the black pupils 1302 will not print because black was removed as a color. The pupils 1302, however, may be shown because the substrate will be black. The RIP Software may also have a mass screening function that removes dark colors when printing on a dark garment. The screening and rasterization functions may save money, soften the substrate, and improve washability and durability.

Figure 14:
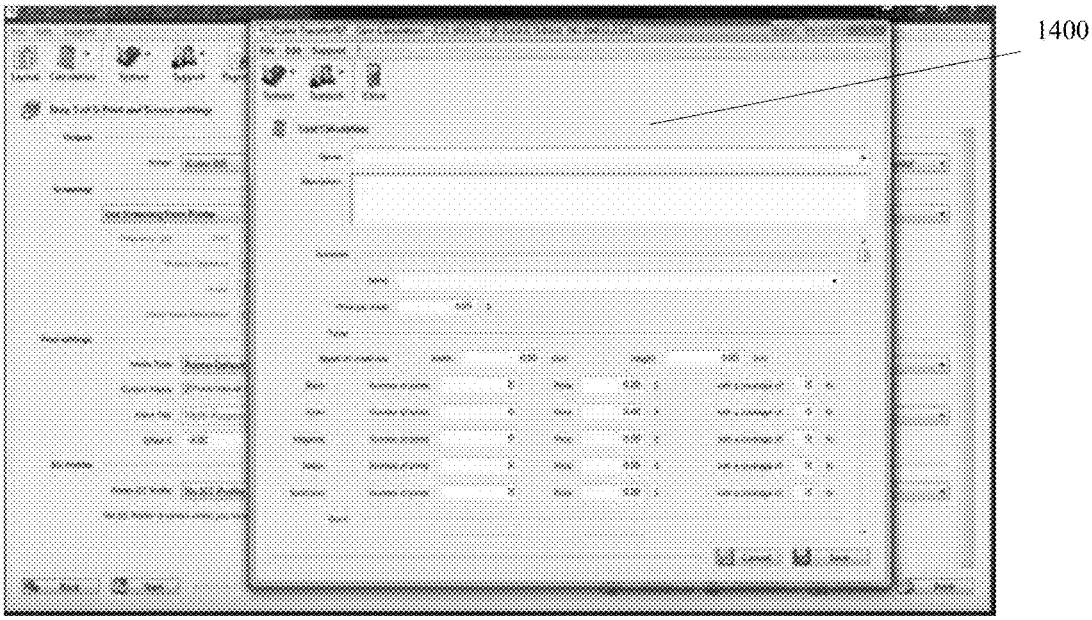
FIG. 14 is an illustration of a cost calculation screen.

FIG. 14 is an illustration of a cost calculation screen. Here, the user may input the costs of each part of the printing process in screen 1400, set the print job, and get a cost calculation summary 1500.

Figure 15:
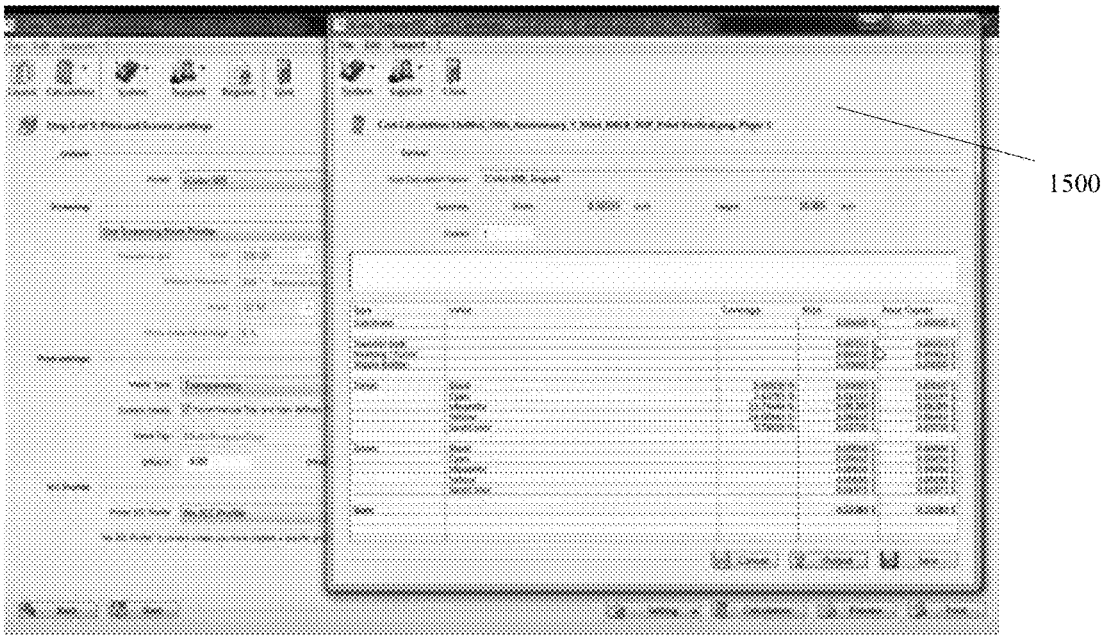
FIG. 15 is an illustration of a cost calculation summary screen.

FIG. 15 is an illustration of a cost calculation summary screen 1500. FIG. 15 shows that the cost calculation summary screen provides the user with a cost per print for the print job that was set up.

The RIP Software may have other layout functions, including combining multiple print jobs to optimize the use of a particular substrate and reduce the amount of remnants of substrate after the print job. This is important for lowering the costs of the print job, especially when using a transfer substrate.

One type of transfer substrate is a plastic heat transfer plastic. When an image is printed on the heat transfer substrate an over print of white may be printed. In this manner, when the heat transfer process is completed the final image has an under layer of white on the substrate to which the image has been transferred. When a heat transfer print job is done, the final print set-up screen 1200 may have a mirror image selection option. This way the image is as desired after being transferred.

Unless otherwise stated, all measurements, values, ratings, positions, magnitudes, sizes, locations, and other specifications, which set forth in this specification, including in the claims that follow, are approximate, not exact. They are intended to have a reasonable range, which is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description, which shows and describes the illustrative embodiments. As will be realized, these embodiments are capable of modifications in various obvious aspects, all without departing from the spirit and scope of the present disclosure. Accordingly, the detailed description is to be regarded as illustrative in nature and not restrictive. Also, although not explicitly recited, one or more additional embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A method of converting a standard CMYK color toner printer to a CMYW toner printer, comprising the steps:

providing a standard CMYK color toner printer, comprising four toner printing cartridges: a cyan toner printing cartridge, a magenta toner printing cartridge, a yellow toner printing cartridge, and a black toner printing cartridge;

wherein said black toner printing cartridge is in a first toner printing cartridge position;

removing said black toner printing cartridge from said standard CMYK color toner printer, such that said first toner printing cartridge position is empty;

providing a white toner printing cartridge;

installing said white toner printing cartridge into said first toner printing cartridge position, such that said standard CMYK color toner printer is now a CMYW toner printer; and wherein said standard CMYK color toner printer lacks a raster imaging processor software, such that said CMYW toner printer does not distinguish said white toner printing cartridge from said black toner printing cartridge, such that said CMYW toner printer prints white rather than black.

2. The method of claim 1, wherein said white toner printing cartridge comprises a printing cartridge chip that allows said CMYK color toner printer to recognize and print using said white toner printing cartridge as an acceptable toner printing cartridge when said white toner printing cartridge is installed into said CMYK color toner printer.

3. A method of converting a CMYK color toner printer to a CMYX color toner printer for under print printing in a single pass, comprising the steps:

providing a color toner printer with four toner printing cartridges: a cyan toner printing cartridge, a magenta toner printing cartridge, a yellow toner printing cartridge, and a black toner printing cartridge;

wherein said black toner printing cartridge is in a first toner cartridge position;

removing said back toner printing cartridge from said first toner cartridge position;

providing a non-standard toner printing cartridge;

installing said non-standard toner printing cartridge into said first toner cartridge position;

providing a raster image processor software;

wherein said raster image processor software is configured to remap said four toner printing cartridges of said color toner printer and allows said color toner printer to print a layer of non-standard toner under an image in a single pass; and wherein said image is printed from at least one of a cyan toner, a yellow toner, and a magenta toner.

4. The method of claim 3, wherein said non-standard toner printing cartridge comprises a chip that allows said non-standard toner printing cartridge to be recognized by said color toner printer.

5. The method of claim 3, wherein said non-standard toner printing cartridge is selected from the group of non-standard toner printing cartridges consisting of: white; clear; and clear fluorescent.

6. The method of claim 3, wherein said raster image processor software is further configured to allow said color toner printer to spot print with said non-standard toner printing cartridge.

7. The method of claim 3, wherein said raster image processor software is further configured to allow said color toner printer to print black by using, in combination, said cyan toner, said magenta toner, and said yellow toner.

8. The method of claim 3, wherein said raster image processor software comprises at least one feature selected from the group of features consisting of:

removing one or more colors from said image to be printed; changing one or more colors of said image; reducing an amount of toner used to print said image; reducing an amount of non-standard toner used to print under said image; increasing said amount of toner used to print said image; increasing said amount of non-standard toner used to print under said image;

rasterizing said image; and providing a cost calculation for printing said image.

9. The method of claim 3, further comprising the step:

printing said image, such that said image is printed above said layer of non-standard toner in a single pass.

10. A method of converting a standard CMYK color toner printer to a CMYX toner printer, comprising the steps:

providing a standard CMYK color toner printer, comprising four toner printing cartridges: a cyan toner printing cartridge, a magenta toner printing cartridge, a yellow toner printing cartridge, and a black toner printing cartridge;

wherein said black toner printing cartridge is in a first toner printing cartridge position;

removing said black toner printing cartridge from said standard CMYK color toner printer, such that said first toner printing cartridge position is empty;

providing a clear toner printing cartridge;

installing said clear toner printing cartridge into said first toner printing cartridge position, such that said standard CMYK color toner printer is now a CMYX toner printer; and wherein said standard CMYK color toner printer lacks a raster imaging processor software, such that said CMYX toner printer does not distinguish said clear toner printing cartridge from said black toner printing cartridge, such that said CMYX toner printer prints clear rather than black.

11. The method of claim 10, wherein said clear toner printing cartridge comprises a printing cartridge chip that allows said CMYK color toner printer to recognize and print using said clear toner printing cartridge as an acceptable toner printing cartridge when said white toner printing cartridge is installed into said CMYK color toner printer.

* * * * *